US005290370A

United States Patent [19]

Okada et al.

[11] Patent Number: 5,290,370

[45] Date of Patent: Mar. 1, 1994

[54] COLD-ROLLED HIGH-TENSION STEEL SHEET HAVING SUPERIOR DEEP DRAWABILITY AND METHOD THEREOF

[75] Inventors: Susumu Okada; Susumu Masui; Susumu Satoh; Kei Sakata; Masahiko Morita; Toshiyuki Kato, all of Chiba, Japan

[73] Assignee: Kawasaki Steel Corporation, Kobe, Japan

[21] Appl. No.: 931,066

[22] Filed: Aug. 17, 1992

[30] Foreign Application Priority Data

Aug. 19, 1991 [JP] Japan ..... 3-230809
Dec. 27, 1991 [JP] Japan ..... 3-346200

[51] Int. Cl.[5] ..... C21D 8/04; C22C 38/12
[52] U.S. Cl. ..... 148/330; 148/603
[58] Field of Search ..... 148/330, 603, 651

[56] References Cited

FOREIGN PATENT DOCUMENTS 1-177321 7/1989 Japan ..... 148/603

*Primary Examiner*—Deborah Yee
*Attorney, Agent, or Firm*—Dvorak and Traub

[57] ABSTRACT

A high-tension steel sheet suitable for deep drawing and having superior surface treatment characteristics is made of a steel consisting essentially of, by weight: 0.001 to 0.05% of C; not more than 1.0% of Si; not more than 2.5% of Mn; 0.05 to 1.0% of Mo; one or both of 0.001 to 0.2% of Nb and not more than 0.3% of Ti, wherein $Ti^*\% + (48/93)Nb\% \geqq (48/12)C\%$ in which $Ti^*\% = Ti\% - (48/32)\ S\% - (48/14)N\%$, wherein, when $Ti^*\% < 0$, $Ti^*\%$ is regarded as being 0; 0.0005 to 0.01% of B; 0.01 to 0.10% of Al; not more than 0.15% of P; not more than 0.010% of S; not more than 0.006% of N; Si, Mn and P meeting the condition of $0.2 < (Si\% + 10P\%)/Mn\% < 3.3$; and the balance substantially Fe and incidental impurities. This steel sheet is produced by a process which includes: hot-rolling the steel slab to obtain a hot rolled steel strip at a final hot-rolling temperature not lower than the $Ar_3$ transformation temperature; coiling the steel strip at a temperature not lower than 300° C. but not higher than 615° C. when Nb is not contained and not lower than 500° C. but not higher than 700° C. when Nb is contained; cold-rolling the steel strip to obtain a cold rolled steel strip at a rolling reduction not smaller than 65%; and recrystallization-annealing the cold rolled strip at a temperature not lower than the recrystallization temperature but below the $Ac_3$ transformation temperature.

4 Claims, 3 Drawing Sheets

COLD-ROLLED HIGH-TENSION STEEL SHEET HAVING SUPERIOR DEEP DRAWABILITY AND METHOD THEREOF

BACKGROUND OF THE INVENTION

1. Field of the Invention

The present invention relates to a cold-rolled high-tension steel for deep drawing suitable for use as the materials of automotive inner and outer panels. The steel has a ferrite single-phase structure, exhibits a tensile strength not lower than 40 kgf/mm$^2$ and has excellent forming workability, as well as superior surface treatment characteristics. The invention also is concerned with a method for producing such a cold-rolled high-tension steel sheet.

2. Description of the Related Art

Cold-rolled steel steels have been used as materials of automotive parts such as structural members and outer panels. In particular, cold-rolled high-tension steel has been used as the material of such steel sheets in order to meet the requirement for reducing the weight of automobile. Important requisites for cold-rolled high-tension steels for use in automobiles are high forming workability, in particular press-workability, strength large enough to provide security of automobiles, and anti-secondary embrittlement characteristic which prevents embrittlement which may occur during secondary processing conducted after the forming work. In recent years, there is an increasing demand for rust prevention of steel sheets and, therefore, surface treating characteristics of the steel sheets are also becoming a matter of great significance.

Legal controls on total exhaust emissions from automotive engines are becoming more strict, which naturally requires reduction in weights of automobiles for reducing fuel consumption. In order to cope with such a demand, it is very important to develop light-weight and strong steel sheets.

Hitherto, various high-tension steel sheets having excellent workability have been proposed. For instance, Japanese Patent Laid-Open No. 57-181361 discloses a cold-rolled steel sheet which has a high Young's modulus and which is suitable for large-size works, as well as a method of producing such a steel sheet. Japanese Patent Laid-Open No. 58-25436 discloses a method of producing a cold-rolled steel sheet which is suitable for deep drawing and which has a high resistance to aging, as well as small anisotropy. These steel sheets are very-low-carbon steels containing a small amount of Nb and Ti and are produced through a continuous annealing conducted under specific conditions. These steels further contain P as reinforcement elements, in order to develop higher tensile strength.

The present inventors have conducted tests on several high-P steels having compositions similar to those shown in the above-mentioned Japanese Patent Laid-Open publications and found that such steels commonly exhibit a reduction in the mean Lankford value after cold-rolling and annealing, as well as inferior performance after painting.

Very-low-carbon steels having a high P content, in particular those having a C content less than 0.002 wt. %, exhibit tensile strength which is 40 kgf/mm$^2$ at the highest, which is still too low to meet the requirements for steel sheets to be used as automotive parts having reduced weight and high strength.

Japanese Patent Publication No. 63-9579 discloses a high-strength cold-rolled steel sheet which contains, as a reinforcement element, Cu in addition to P and which exhibits high tensile strength not smaller than 40 kgf/mm$^2$, as well as a high quality sheet surface. This steel sheet, however, still exhibits inferior surface treatment characteristics.

OBJECT OF THE INVENTION

Accordingly, an object of the present invention is to provide a cold-rolled high-tension steel sheet suitable for use as automotive inner or outer panels wherein the steel composition has been suitably determined to simultaneously satisfy the requirements for superior mechanical properties and surface treatment characteristics and to provide a tensile strength not lower than 40 kgf/mm$^2$.

Another object of the present invention is to provide a method of producing such a cold-rolled steel sheet.

Through an intense study, the present inventors discovered that a cold-rolled high-tension steel sheet suitable for use as automotive inner or outer panels having a tensile strength not lower than 40 kgf/mm$^2$ is obtainable by adequately determining the contents of Si, Mn and P in relation to one another and by addition of suitable amounts of Mo and Ti and/or Nb.

The present invention is based upon such a discovery.

According to one aspect of the present invention, there is provided a high-tension steel sheet suitable for deep drawing and having superior surface treatment characteristics, said steel sheet being made of a steel consisting essentially of, by weight: 0.001 to 0.05% of C; not more than 1.0% of Si; not more than 2.5% of Mn; 0.05 to 1.0% of Mo; one or both of 0.001 to 0.2% of Nb and not more than 0.3% of Ti, wherein $Ti^*\% + (48/93)Nb\% \geqq (48/12)C\%$ in which $Ti^*\% = Ti\% - (48/32)S\% - (48/14)N\%$, wherein, when $Ti^*\% < 0$, $Ti^*\%$ is regarded as being 0; 0.0005 to 0.01% of B; 0.01 to 0.10% of Al; not more than 0.15% of P; not more than 0.010% of S; not more than 0.006% of N; Si, Mn and P meeting the condition of $0.2 < (Si\% + 10P\%)/Mn\% < 3.3$; and the balance substantially Fe and incidental impurities.

According to another aspect of the present invention, there is provided a method of producing a high-tension steel sheet suitable for deep drawing and having superior surface treatment characteristics, comprising the steps of:

preparing a steel slab made of a steel consisting essentially of, by weight: 0.001 to 0.05% of C; not more than 1.0% of Si; not more than 2.5% of Mn; 0.05 to 1.0% of Mo; one or both of 0.001 to 0.2% of Nb and not more than 0.3% of Ti, wherein $Ti^*\% + (48/93)Nb\% \geqq (48/12)C\%$ in which $Ti^*\% = Ti\% - (48/32)S\% - (48/14)N\%$, wherein, when $Ti^*\% < 0$, $Ti^*\%$ is regarded as being 0; 0.0005 to 0.01% of B; 0.01 to 0.10% of Al; not more than 0.15% of P; not more than 0.010% of S; not more than 0.006% of N; Si, Mn and P meeting the condition of $0.2 < (Si\% + 10P\%)/Mn\% < 3.3$; and the balance substantially Fe and incidental impurities;

hot-rolling said steel slab to obtain a hot rolled steel strip at a final hot-rolling temperature not lower than the $Ar_3$ transformation temperature; coiling said steel strip at a temperature not lower than 300° C. but not higher than 615° C. when Nb is not contained and not lower than 500° C. but not higher than 700° C. when Nb is contained; cold-rolling said steel strip to obtain a cold rolled steel strip at a rolling reduction not smaller than 65%; and recrystallization-annealing said cold rolled strip at a temperature not lower than the recrystallization temperature but below the $Ac_3$ transformation temperature.

The above and other objects, features and advantages of the present invention will become clear from the following description taken in conjunction with the accompanying drawings.

DETAILED DESCRIPTION OF THE INVENTION

A description will now be given of the results of experiments which provide basis for the invention of the present application.

Experiment 1

Experiments were conducted to determine the optimum balance between Si, Mn and P contents. More specifically, experiments were executed separately in regard to Si and P which, when their contents are large, adversely affect the surface treatment characteristics and in regard to Mn which, when its content is large, seriously impairs ductility and deep drawability. The inventors discovered the following facts as a result of these experiments.

Various steel slabs were prepared to have compositions of C: 0.008 wt. %, Mo: 0.25 wt. %, Ti: 0.055 wt. %, Nb: 0.030 wt. %, B: 0.001 wt. %, Al: 0.045 wt. %, S: 0.002 wt. % and N: 0.002 wt. %, with addition of Si, Mn and P, the Si content being varied within the range of 0.01 to 1.00 wt. %, Mn content being varied with the range of 0.30 to 2.50 wt. % and the P content being varied within the range of 0.01 to 0.15 wt. %. Each steel slab was hot-rolled to obtain a hot rolled steel strip at a finish rolling temperature of 890° C. and then thus obtained hot rolled steel strip was coiled into a coil at 560° C., followed by a cold rolling conducted at a rolling reduction of 70 to 75%, so as to become a cold-rolled strip of 0.8 mm thick. The cold-rolled strip was then subjected to a continuous annealing between 800 and 830° C. Some of the continuously-annealed steel strips were subjected to phosphating, hot-dip zinc plating and Zn-Ni electroplating. Phosphating was conducted by full-dipping, using, as the treating solution, PALBOND L3020 produced by Nippon Parkerizing.

The dipping period was 120 seconds and the temperature of the treating bath was 42° C.

The hot-dip zinc plating was conducted to obtain a zinc deposition amount of 45 g/m$^2$, under the conditions of: bath temperature of 475° C., initial sheet temperature of 475° C., dipping time of 3 seconds, and alloying temperature of 485° C. The Zn-Ni electroplating was conducted to obtain a deposition amount of 30 g/m$^2$.

The thus treated steel strips were subjected to a tensile test, as well as tests for examining surface treatment characteristics: in particular, phosphating treatment characteristics, anti-powdering characteristics, i.e., resistance to powdering exhibited by a hot-dip plating layer and adhesiveness of Zn-Ni electroplating.

The phosphating treatment characteristics were synthetically evaluated in five ranks on the basis of factors including the weight of the coating film, P ratio, crystal grain size and crystal grain distribution.

The anti-powdering characteristics and adhesiveness were examined by bending tests and were evaluated in five ranks, respectively.

Figure 1:
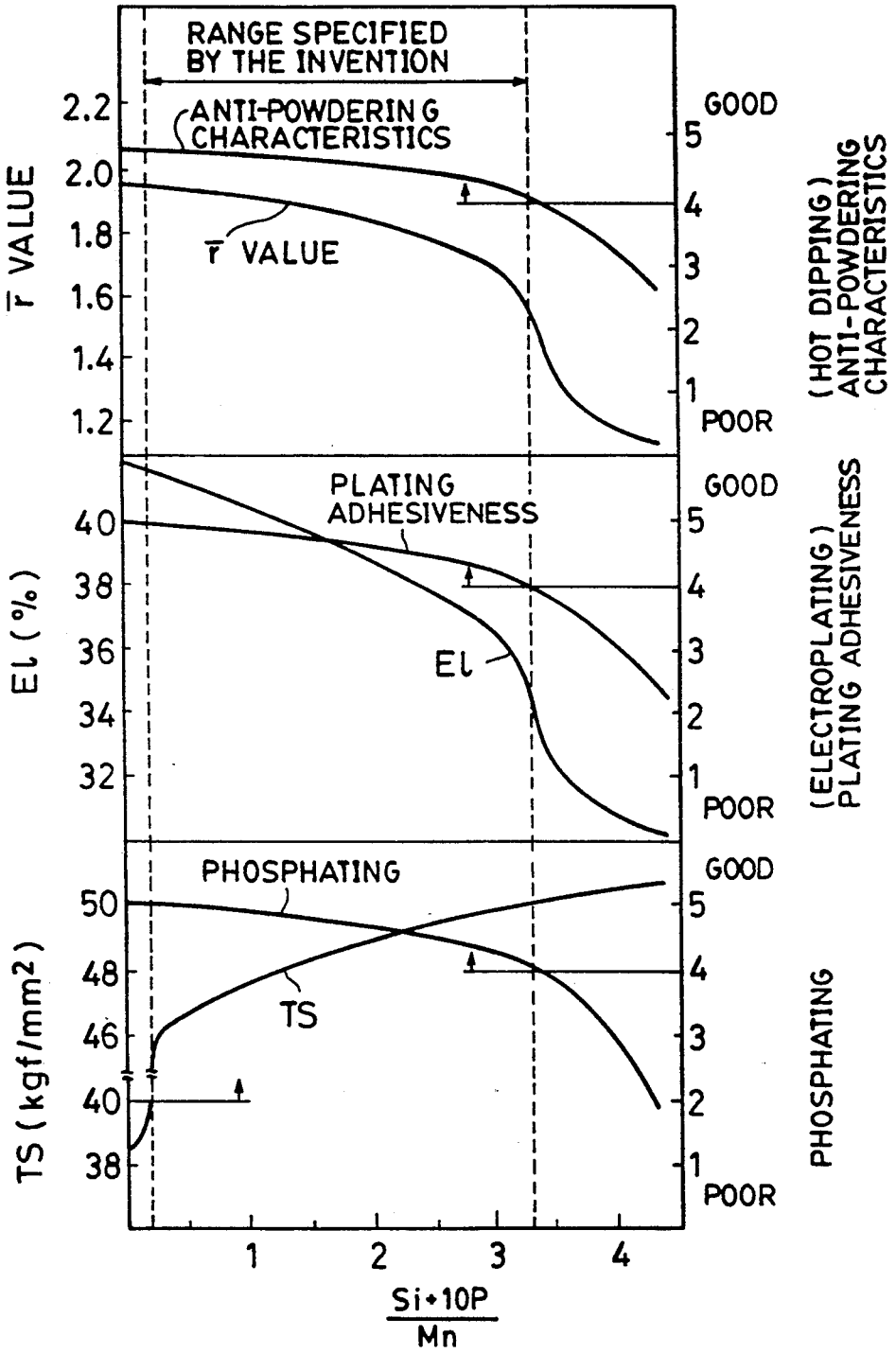
FIG. 1 is a chart showing tensile strength, elongation, Lankford value ($\bar{r}$ value) and various surface treatment characteristics of a thin cold-rolled steel sheet in relation to a factor (Si Wt% +10P wt. %)/Mn wt. %.

FIG. 1 shows how the tensile strength, elongation, average Lankford value ($\bar{r}$ value) and the surface treatment characteristics are varied by a factor (Si wt. %+10P wt. %)/Mn wt. %, as obtained through the tests described above.

As will be seen from FIG. 1, when the factor (Si wt. %+10P wt. %)/Mn wt. % is 0.2 or less, the tensile strength (TS) does not reach the desired level of 40 kgf/mm$^2$, although the elongation El and the Lankford value ($\bar{r}$ value) are acceptable. Conversely, when the factor (Si wt. % +10P wt. %)/Mn wt. % exceeds 3.3, the elongation El and the Lankford value ($\bar{r}$ value) as well the surface treatment characteristics, are seriously impaired. It is thus understood both the excellent tensile characteristics and surface treatment characteristics are obtained when the above-mentioned factor falls within the range given by:

$$0.2 < (\text{Si wt. \%} + 10\text{P wt. \%})/\text{Mn wt. \%} < 3.3$$

Further experiments showed that the above-described advantageous effects are maintained even when suitable amounts of Ni and Cu, which have a solid solution strengthening effect, are added to the steel compositions.

Experiment 2

Four types of steel slabs having chemical compositions with different C contents, one of them containing Mo, were prepared and hot-rolled to obtain steel strips at a rolling finish temperature of 890° C. and thus obtained steel strip were wound up into coil form at a temperature of 600° C. followed by a cold-rolling conducted at rolling reduction of 75% to become steel sheets of 0.7 mm thick. The thus obtained cold rolled strips were then continuously annealed at 800° C.

TABLE 1

| | (wt %) | | | | | | | | | |
|---|---|---|---|---|---|---|---|---|---|---|
| Steel type | C | Si | Mn | Mo | Ti | B | Al | P | S | N |
| 45C | 0.0045 | 0.10 | 0.60 | | 0.042 | 0.0009 | 0.046 | 0.048 | 0.002 | 0.0029 |
| 70C | 0.0070 | 0.10 | 0.59 | | 0.051 | 0.0009 | 0.040 | 0.050 | 0.002 | 0.0019 |
| 90C | 0.0090 | 0.10 | 0.61 | | 0.062 | 0.0007 | 0.048 | 0.049 | 0.002 | 0.0016 |

TABLE 1-continued

| Steel type | C | Si | Mn | Mo | Ti | B | Al | P | S | N |
|---|---|---|---|---|---|---|---|---|---|---|
| | | | | (wt %) | | | | | | |
| 70CM | 0.0070 | 0.10 | 0.60 | 00.20 | 0.049 | 0.0011 | 0.050 | 0.049 | 0.002 | 0.0024 |

These four types of steel strips were subjected to tensile tests.

Figure 2:
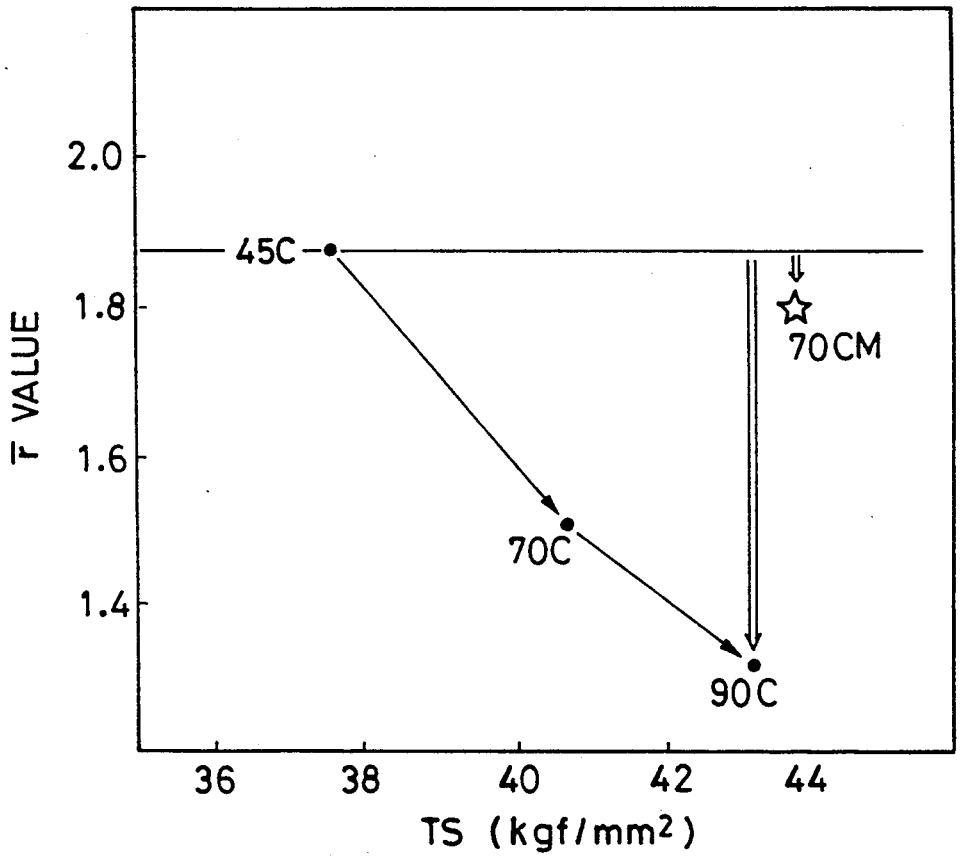
FIG. 2 is a chart showing the effect of controlling the C content and the effect produced by the addition of Mo on the tensile strength (TS) and Lankford value ($\bar{r}$ value) of a steel sheet.

FIG. 2 shows the effect of controlling the C content and the effect of the addition of Mo on the Lankford value ($\bar{r}$ value) and the tensile strength as determined in accordance with the results of the tests described above.

As will be seen from FIG. 2, the C content was increased in a stepped manner starting from 45C steel with the result that the tensile strength (TS) was increased while the Lankford value ($\bar{r}$ value) was decreased as the C content was increased. The 70CM steel containing Mo, however, showed only a small reduction of the Lankford value ($\bar{r}$ value) while exhibiting tensile strength (TS) which is even higher than that of the 70C steel.

The reason why the addition of Mo suppresses a reduction in the Lankford value ($\bar{r}$ value) while improving the tensile strength (TS) has not yet been theoretically determined. This phenomenon may might be attributed to the fact that the addition of Mo causes only a very small change in the texture.

It is understood, however, that the addition of Mo is effective in improving tensile strength (TS) while suppressing reduction in the Lankford value ($\bar{r}$ value).

Experiment 3

Eight types of steel slabs A to H having chemical compositions shown in Table 2, some of them containing Mo and/or Nb, were prepared and hot-rolled to obtain hot rolled steel strips at rolling finish temperature of 890° C. and then thus obtained strips were coiled at the temperatures shown in Table 2, followed by a cold-rolling conducted at rolling reduction of 75% so as to become steel strips of 0.7 mm thick. The steel strips were then continuously annealed at 800° C. The coiling temperature was varied within the range between 400 and 700° C. and was 600° C. for other steels.

TABLE 2

| Steel type | Composition (wt %) | | | | | | | | | | | Coiling temp. (°C.) |
|---|---|---|---|---|---|---|---|---|---|---|---|---|
| | C | Si | Mn | Mo | Nb | Ti | B | Al | P | S | N | |
| A | 0.0050 | 0.12 | 0.49 | — | — | 0.054 | 0.0007 | 0.047 | 0.045 | 0.005 | 0.0021 | 600 |
| B | 0.0048 | 0.11 | 0.98 | — | — | 0.056 | 0.0010 | 0.043 | 0.044 | 0.004 | 0.0023 | 600 |
| C | 0.0051 | 0.11 | 1.51 | — | — | 0.058 | 0.0008 | 0.044 | 0.043 | 0.005 | 0.0022 | 600 |
| D | 0.0053 | 0.10 | 1.50 | 0.21 | — | 0.057 | 0.0009 | 0.045 | 0.045 | 0.005 | 0.0019 | 600 |
| E | 0.0055 | 0.11 | 1.48 | — | 0.023 | 0.060 | 0.0007 | 0.040 | 0.045 | 0.005 | 0.0021 | 600 |
| F | 0.0050 | 0.11 | 1.50 | 0.20 | 0.025 | 0.062 | 0.0008 | 0.044 | 0.046 | 0.005 | 0.0020 | 400 to 750 |
| G | 0.0044 | 0.12 | 2.05 | — | — | 0.054 | 0.0012 | 0.050 | 0.044 | 0.004 | 0.0020 | 600 |
| H | 0.0047 | 0.11 | 3.01 | — | — | 0.058 | 0.0010 | 0.046 | 0.045 | 0.005 | 0.0022 | 600 |

These eight types of steel strips were subjected to tensile tests. Tensile strength values and Lankford values ($\bar{r}$ value) are shown in FIG. 3.

Figure 3:
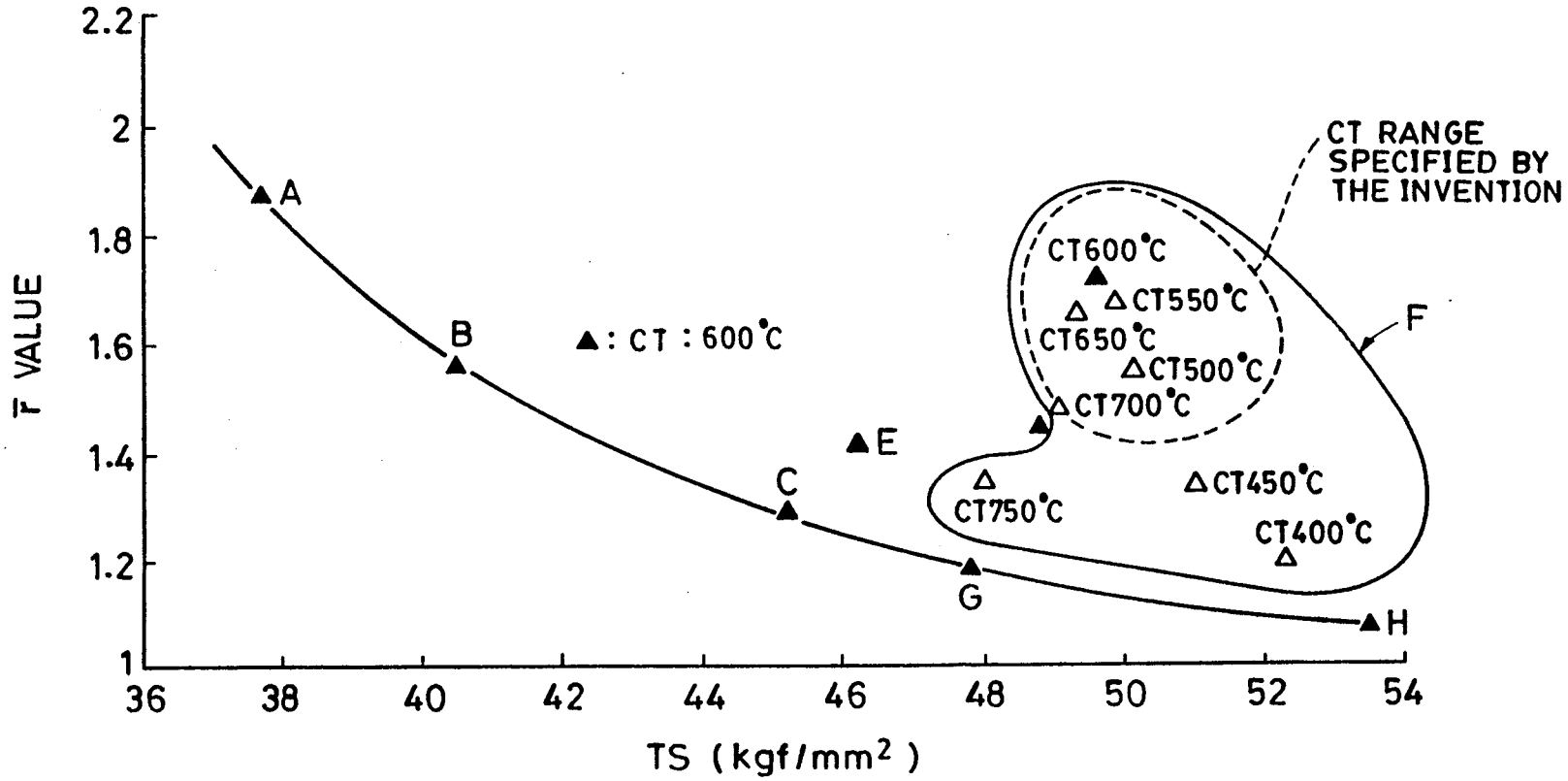
FIG. 3 is a chart showing the effect of controlling the Mn content and effect of addition of Nb, as well as the effect produced by controlling the coiling temperature, on the tensile strength (TS) and the Lankford value ($\bar{r}$ value) of the steel sheet.

As will be seen from FIG. 3, the Mn content was increased in a stepped manner starting from the steel A to steels B, C, G and H, with the result that the tensile strength (TS) was increased while the Lankford value (f value) was decreased as the Mn content was increased. Steels D, E and F containing Mo and/or Nb, however, showed only small reductions of the Lankford value ($\bar{r}$ value), while exhibiting a tensile strength (TS) which is even substantially the same as that of other steels having substantially similar Mn contents.

Among the steel samples coiled at 600° C., the steel F containing both Mo and Nb showed the best balance between the tensile strength (TS) and the Lankford value ($\bar{r}$ value), as well as the highest value of the tensile strength (TS). From FIG. 3, it is also understood that among a plurality of samples of the steel F, the best balance is obtained when the coiling temperature ranges between 500 and 700° C.

From these test results, it is understood that the addition of Mo and Nb and coiling at a temperature between 500 and 700° C. are effective in increasing the tensile strength (TS) without impairing deep drawability.

In particular, Nb provides a remarkable effect in improving texture, although its strengthening effect is not as large as that of Mo. Thus, Nb, when used in combination with Mo, provides a good balance between deep drawability and strength, appreciable levels of deep drawability and strength. The effect of Nb in improving texture largely owes to the crystal grain size of the hot-rolled steel strip and the grain sizes of precipitate which is mostly Nb carbides. More specifically, when the coiling temperature is too high, the crystal grain size becomes so large that formation of recrystallized structure, which provides deep drawability, is impaired. Conversely, when the coiling temperature is too low, the precipitates are excessively refined so that the growth of crystals, which form advantageous texture, is impaired. The optimum range of the coiling temperature determined through the experiments is supported by the above discussion.

Ti also provides an appreciable effect in improving texture, when used in combination with Mo.

A description will now be given for the limitation on the following chemical composition range disclosed in the invention of this application.

C: 0.001 to 0.05 wt. %

Any C content less than 0.001 wt. % cannot provide the desired tensile strength of 40 kg/mm$^2$ or greater. On the other hand, addition of C in excess of 0.05 wt. % makes it impossible to obtain the desired ductility. Furthermore, addition of such a large amount of C requires that a greater amount of Ti be added in order to fix C, which undesirably raises the material cost. Therefore, the C content is preferably not less than 0.001 wt. % but not more than 0.05 wt. %. In order to obtain higher strength, the C content should be 0.002 wt. % or greater.

Si: 1.0 wt. % or less

Si is an element which exhibits high solid solution strengthening effect, and is added for the purpose of increasing strength. Addition of this element in excess of 1.0 wt. %, however, impairs phosphating treatment characteristics, hot-dip plating characteristics and electroplating characteristics. In addition, the discalling characteristic during hot-rolling is also impaired. The Si content, therefore, is determined to be 1.0 wt. % or less.

Mn: 2.5 wt. % or less

Mn is also an element which provides a high solid-solution strengthening effect, and is added for the purpose of improving the strength. This element also provides an effect to fix S when used in a steel which is free of Ti. Addition of Mn in excess of 2.5 wt. %, however, seriously impairs both ductility and deep drawability. The content of this element, therefore, should be 2.5 wt. % or less.

Mo: 0.05 to 1.0 wt. %

Mo, when its content is adequately adjusted, effectively prevents reduction in ductility and deep drawability while allowing an increase in the strength. This effect becomes appreciable when the content of this element becomes 0.05 wt. % or greater. Addition of this element in excess of 1.0 wt. % causes a serious reduction in ductility and deep drawability, with the result that the cost is increased. The content of Mo, therefore, is preferably not less than 0.5 wt. % but not more than 1.0 wt. %, more preferably not more than 0.5 wt. %.

Ti, Nb:

Each of Ti and Nb may be added alone or both of them may be used in combination. Preferably, Nb content is from 0.001 to 0.2 wt. % and Ti content is preferably 0.3 wt. % or less. The Nb and Ti contents also should be determined to meet the condition of:

$$Ti^* \text{ wt. } \% + (48/93)\ Nb \text{ wt. } \% \geqq (48/12)\ C \text{ wt. } \%$$

wherein Ti* wt. %=Ti wt. %−(48/32) S wt. %−(48/14) N wt. % and wherein, when Ti* wt. %<0, Ti* wt. % is regarded as being 0 (zero).

Ti has an effect to fix C, S and N, while Nb fixes C. As is well known, solid-solution C and N adversely affect workability, while S tends to cause hot-work cracking. In order to improve workability, therefore, it is important to fix C, S and N by adding Ti and Nb. Furthermore, as described before, Nb provides an effect to improve the balance between strength and deep drawability. It is to be noted, however, the optimum coiling temperature varies depending on whether Nb is present or not.

Precipitation fixing of C is the most critical requisite for obtaining good workability. Whether fixing of C is sufficient or not is determined as follows. Ti exhibits a greater tendency to be bonded to N and S than to C. Therefore, the effective Ti content Ti* for forming TiC is given by Ti wt. %−(48/32) S wt. %−(48/14) N wt. %. In contrast, Nb is bonded only to C so as to form NbC. The effective Nb content is therefore substantially the same as the amount of Nb added. Therefore, the lower limits of Ti and Nb necessary for fixing C are determined by the formula $$Ti^* \text{ wt. } \% + (48/93)\ Nb \text{ wt. } \% \geqq (48/12)\ C \text{ wt. } \%$$

In order that Nb makes a contribution to the improvement in the balance between the strength and deep drawability, it is necessary that Nb is added by an amount of 0.001 wt. % or greater. Conversely, when Nb content exceeds 0.2 wt. % while Ti content is 0.3 wt. %, the material is degraded and the surface quality of the steel sheet is impaired by solid solution of Ti and Nb. Therefore, preferably, the Nb content is from 0.001 to 0.2 wt. % and Ti content is preferably 0.3 wt. % or less. The Nb and Ti contents also should be determined to meet the condition of:

$$Ti^* \text{ wt. } \% + (48/93)\ Nb \text{ wt. } \% \geqq (48/12)\ C \text{ wt. } \%$$

wherein Ti* wt. %=Ti wt. %−(48/32) S wt. %−(48/14) N wt. % and wherein, when Ti* wt. %<0, Ti* wt. % is regarded as being 0 (zero).

Since the maximum allowable Nb content is 0.2 wt. %, the C content cannot exceed 0.025% when Ti is not added.

It is also to be noted that, provided that Ti is added by an amount satisfying the condition of Ti wt. %≧(48/12) C wt. %+(48/32) S wt. %+(48/14) N wt. %. the whole solid-solution C should be fixed by Ti alone in a equilibrium state. An experiment made by the present inventors, however, showed that, even under such a state, recrystallization grain size and fiber structure are dependent on the coiling temperature in the state characterized by Nb-containing steels. It is therefore considered that a considerable amount of NbC is present when hot rolling is conducted under ordinary conditions.

B: 0.0005 to 0.01 wt. %

B has an effect to improve resistance to secondary work embrittlement, phosphating treatment characteristics and spot weldability. These effects become appreciable when the content of B is 0.0005 wt. % or greater. Addition of B in excess of 0.01 wt. %, however, causes slab cracking and impairs deep drawability. The B content, therefore, should be not less than 0.0005 wt. % but not less than 0.01 wt. %.

Al: 0.01 to 0.10 wt. %

Al is an element which fixes O in the steel so as to suppress reduction in the effective Ti content which may otherwise occur due to the bonding of Ti to O. Al also is effective in fixing N when the steel does not contain Ti. No appreciable effect is produced when the Al content is below 0.01 wt. %, whereas, when the Al content is increased beyond 0.10 wt. %, the effect of the addition of Al is saturated and the surface state is impaired due to a rapid increase in non-metallic inclusions. The Al content, therefore, should be not less than 0.01 wt. % but not more than 0.10 wt. %.

P: 0.15 wt. % or less

P is an element which produces an excellent solid-solution strengthening effect and is added for the purpose of improving strength. The addition of this element in excess of 0.15 wt. %, however, not only impairs phosphating treatment characteristics and hot-dip and electroplating characteristics but also causes an undesirable effects on the quality of the steel sheet surface. The addition of such large amount of P also tends to produce coarse FeTiP during hot rolling, which in turn causes a reduction in the Lankford value ($\bar{r}$ value) after annealing conducted following cold rolling. The P content, therefore, should be not more than 0.15 wt. %.

S: 0.010 wt. % or less

S not only causes cracking during hot rolling but undesirably increases amount of Ti which is to be added to fix S. Consequently, the cost of the material is increased. The S content therefore should be minimized but the presence of S up to 0.010 wt. % is acceptable.

N: 0.006 wt. % or less

Addition of a large amount of N causes a reduction in Lankford value ($\bar{r}$ value) and causes a rise in the cost due to the increase in the content of Ti which is necessary for fixing N, with the result that the cost of the material is correspondingly increased. The allowable upper limit of N content is 0.006 wt. %.

Ni, Cu: 0.05 to 2.0 wt. % (Ni added alone or together with Cu)

Both Ni and Cu produce a solid-solution strengthening effect and are added for the purpose of improving strength. The effects of both elements are appreciable when their contents are 0.05 wt. % or greater. However, when the contents exceed 2.0 wt. %, deterioration in ductility and deep drawability, as well as serious degradation in the quality of the steel sheet surface occur. Consequently, the contents of both Ni and Cu should be not less than 0.05 wt. % but not more than 2.0 wt. %. Addition of Cu alone tends to cause surface defects during hot rolling, so that addition of Cu essentially requires the simultaneous addition of Ni.

If there is a margin for strength, both the Ni content and the Cu content should be not more than 0.7 wt. %. Strengthening effect is slightly reduced when the Cu content is not more than 0.2 wt. %, but such a reduction is not critical.

According to the present invention, in addition to the restriction of the chemical composition set forth above, it is necessary that the contents of Si, Mn and P satisfy the requirements of:

$$0.2 < (\text{Si wt. \%} + 10\text{P wt. \%})/\text{Mn wt. \%} < 3.3$$

This is because the required tensile strength is not obtained when the above-mentioned ratio is 0.2 or less, whereas, when the ratio has a value of 3.3 or greater, deep drawability is seriously degraded.

A description will now be given of the restrictions on the process conditions.

Hot rolling conditions

The final hot-rolling temperature should be below the $Ar_3$ transformation point or the Lankford value ($\bar{r}$ value) is reduced and the planer anisotropy is enhanced after annealing subsequent to cold rolling. The final hot-rolling temperature, therefore, should be not lower than $Ar_3$ transformation temperature. Although no upper limit temperature is posed, the final hot-rolling temperature is not higher than a temperature which is 50° C. higher than the $Ar_3$ transformation temperature.

Preferably, the hot-rolling is conducted such that the continuously-cast slab is temporarily cooled and, after a reheating, rough-rolled followed by final rolling. In order to save energy, it is also preferred to subject the continuously-cast slab to rough-rolling without allowing the slab to cool down below $Ar_3$ transformation temperature without delay or after a temperature holding treatment.

Coiling temperature

Optimum coiling temperature varies depending on whether Nb is contained or not. When Nb is not contained, i.e., when Ti is added alone, the coiling temperature preferably is not less than 300° C. and not higher than 615° C.

The generation of FeTiP tends to occur when the coiling temperature exceeds 615° C. and causes a reduction in the Lankford value ($\bar{r}$ value) after annealing subsequent to the cold rolling. Conversely, when the coiling temperature is below 300° C., the rolling load becomes excessively large so that the rolling mill is heavily burdened to impair smooth operation of the mill.

When Nb is contained, regardless of whether Ti is added or not, the coiling temperature is not less than 500° C. but not higher than 700° C. Improperly low coiling temperature tends to cause excessive refinement of precipitates, which hampers formation of texture useful for improving deep drawability. Conversely, too high a coiling temperature tends to coarsen the crystal grains which also impedes formation of texture effective for attaining large deep drawability.

Cold rolling and annealing

The rolling reduction in the cold rolling should be not less than 65% or the required workability is not obtained even when other process conditions are optimized. The temperature of annealing conducted after the cold rolling should be not lower than recrystallization temperature as in ordinary processes. However, annealing at a temperature exceeding the $Ar_3$ transformation temperature causes a serious reduction in the Lankford value ($\bar{r}$ value) after the cooling. The annealing temperature, therefore, should be not lower than the recrystallization temperature but not higher than the $Ar_3$ transformation temperature. The annealing may be continuous annealing or box annealing.

It is also possible to effect temper rolling under commonly accepted conditions for the purpose of, for example, leveling of the steel sheets. More specifically, temper rolling may be conducted at a reduction ratio (%) equal to the sheet thickness (mm).

EXAMPLE 1

With addition of Ti

Seventeen types of steel slabs having chemical compositions shown in Table 3 were prepared and finally cold rolled into steel sheets of 0.7 mm thick. Nine out of seventeen steel slabs were prepared to meet the requirements of the invention, while eight were prepared for the purpose of comparison. Some of these slabs were rolled to sheets and subjected to phosphating treatment, hot-dip plating and Zn-Ni electroplating. Tensile characteristics and surface treatment characteristics of these steel sheets were examined. The results are shown in Table 4 together with the conditions of the hot-rolling, cold-rolling and annealing.

Phosphating treatment, hot-dip since plating and Zn-Ni electroplating were conducted under the following conditions.

Phosphating treatment

Treating liquid: Palbond L3020 produced by Nippon Parkerizing Kabushiki Kaisha
Treatment type: Full dipping
Treating condition: 120-second dipping at 42° C.

Hot-dip zinc plating

Bath temperature: 475° C. Alloying temperature: 485 ° C.
Sheet initial temperature: 475° C.
Deposition amount: 45 g/m$^2$
Immersion time: 3 seconds Zn-Ni electroplating Deposition amount: 30 g/m$^2$

TABLE 3

| Steel type | Composition (wt %) C | Si | Mn | Ni | Mo | Ti | B | Cu | Al | P | S | N | Tic* | (Si + 10P)/Mn |
|---|---|---|---|---|---|---|---|---|---|---|---|---|---|---|
| A | 0.0045 | 0.25 | 0.60 | | 0.35 | 0.042 | 0.0010 | | 0.048 | 0.046 | 0.0020 | 0.0029 | 0.0073 | 1.22 |
| B | 0.0090 | 0.10 | 0.51 | | 0.24 | 0.062 | 0.0007 | | 0.048 | 0.059 | 0.0020 | 0.0016 | 0.013 | 1.35 |
| C | 0.0160 | 0.15 | 0.39 | | 0.16 | 0.080 | 0.0009 | | 0.042 | 0.067 | 0.0020 | 0.0017 | 0.018 | 2.10 |
| D | 0.0060 | 0.30 | 0.60 | | 0.22 | 0.051 | 0.0011 | | 0.052 | 0.029 | 0.0020 | 0.0024 | 0.0099 | 0.99 |
| E | 0.0025 | 0.19 | 0.36 | 0.09 | 0.18 | 0.050 | 0.0009 | 0.09 | 0.036 | 0.056 | 0.0040 | 0.0019 | 0.0094 | 2.08 |
| F | 0.0290 | 0.22 | 0.35 | | 0.09 | 0.178 | 0.0008 | | 0.050 | 0.061 | 0.0019 | 0.0019 | 0.042 | 2.37 |
| G | 0.0240 | 0.30 | 0.29 | 0.10 | 0.19 | 0.110 | 0.0010 | 0.10 | 0.046 | 0.058 | 0.0020 | 0.0024 | 0.025 | 3.04 |
| H | 0.0480 | 0.45 | 0.40 | | 0.13 | 0.280 | 0.0008 | | 0.047 | 0.037 | 0.0020 | 0.0017 | 0.061 | 2.05 |
| I | 0.005 | 0.50 | 1.20 | | 0.20 | 0.060 | 0.0010 | | 0.040 | 0.050 | 0.0030 | 0.0050 | 0.0096 | 0.91 |
| J | 0.0085 | 0.10 | 0.25 | | 0.25 | 0.044 | 0.0012 | | 0.043 | 0.160 | 0.0025 | 0.0018 | 0.0085 | 6.80 |
| K | 0.0230 | 1.10 | 0.29 | | 0.15 | 0.108 | 0.0012 | | 0.046 | 0.040 | 0.0020 | 0.0023 | 0.024 | 5.17 |
| L | 0.0045 | 0.05 | 2.70 | 0.10 | 0.35 | 0.029 | 0.0009 | 0.15 | 0.040 | 0.045 | 0.0030 | 0.0016 | 0.0048 | 0.18 |
| M | 0.0550 | 0.36 | 0.42 | | 0.10 | 0.240 | 0.0008 | | 0.045 | 0.050 | 0.0020 | 0.0015 | 0.0058 | 2.04 |
| N | 0.0230 | 0.45 | 0.55 | | 0.20 | 0.077 | 0.0008 | | 0.048 | 0.048 | 0.0020 | 0.0016 | 0.017 | 1.69 |
| O | 0.0060 | 0.05 | 0.75 | | 0.22 | 0.051 | 0.0011 | | 0.052 | 0.006 | 0.0020 | 0.0024 | 0.0099 | 0.14 |
| P | 0.0240 | 0.35 | 0.19 | 0.10 | 0.19 | 0.110 | 0.0010 | 0.10 | 0.046 | 0.063 | 0.0020 | 0.0024 | 0.025 | 5.16 |
| Q | 0.0095 | 0.30 | 0.60 | | | 0.051 | 0.0011 | | 0.052 | 0.029 | 0.0020 | 0.0024 | 0.0099 | 0.99 |

Tic* = 12/48(Ti wt %-48/32 S wt %-48/14 N wt %)

Steels A to I meet requirements of invention, while steels J to Q are comparison examples.

TABLE 4

| Sample No. | Sample Symbol | Final roll temp. (°C.) | $Ar_3$ trans-form temp. (°C.) | Coiling temp. (°C.) | Cold rolling reduction (%) | Annealing temp. (°C.) | Re-crystalli-zation temp. (°C.) | $Ar_3$ trans-form temp. (°C.) | TS (kgf/mm$^2$) | YS (kgf/mm$^2$) | El (%) | $\bar{r}$ value | phosphating characteristics | Platability: Electro plating | Platability: Hot-dip plating | Invention or Comparison Example |
|---|---|---|---|---|---|---|---|---|---|---|---|---|---|---|---|---|
| 1 | A | 880 | 876 | 480 | 75 | 800 | 669 | 884 | 42 | 25 | 40 | 1.8 | ○ | ○ | ○ | Invention |
| 2 | A | 850 | 876 | 580 | 80 | 830 | 669 | 884 | 43 | 27 | 38 | 1.3 | ○ | ○ | ○ | Comp. Ex |
| 3 | A | 880 | 876 | 700 | 78 | 800 | 669 | 884 | 43 | 26 | 39 | 1.4 | ○ | ○ | ○ | Comp. Ex |
| 4 | B | 880 | 869 | 600 | 77 | 800 | 676 | 876 | 42 | 26 | 39 | 1.7 | ○ | ○ | ○ | Invention |
| 5 | B | 870 | 869 | 590 | 60 | 830 | 676 | 876 | 44 | 29 | 35 | 1.2 | ○ | ○ | ○ | Comp. Ex |
| 6 | B | 900 | 969 | 600 | 76 | 650 | 676 | 876 | 51 | 31 | 23 | 1.1 | ○ | ○ | ○ | Comp. Ex |
| 7 | C | 870 | 862 | 590 | 80 | 830 | 679 | 870 | 44 | 27 | 38 | 1.6 | ○ | ○ | ○ | Invention |
| 8 | C | 830 | 862 | 580 | 81 | 860 | 679 | 870 | 45 | 28 | 37 | 1.2 | ○ | ○ | ○ | Comp. Ex |
| 9 | D | 890 | 870 | 600 | 72 | 800 | 671 | 879 | 43 | 26 | 40 | 1.7 | ○ | ○ | ○ | Invention |
| 10 | D | 880 | 870 | 620 | 77 | 800 | 671 | 879 | 43 | 27 | 39 | 1.3 | ○ | ○ | ○ | Comp. Ex |
| 11 | D | 870 | 870 | 590 | 63 | 860 | 671 | 879 | 45 | 31 | 31 | 1.2 | ○ | ○ | ○ | Comp. Ex |
| 12 | E | 890 | 882 | 540 | 75 | 790 | 664 | 891 | 43 | 25 | 40 | 1.8 | ○ | ○ | ○ | Invention |
| 13 | E | 900 | 882 | 600 | 74 | 650 | 664 | 891 | 46 | 29 | 27 | 1.1 | ○ | ○ | ○ | Comp. Ex |
| 14 | E | 850 | 882 | 580 | 78 | 830 | 664 | 891 | 44 | 27 | 38 | 1.3 | ○ | ○ | ○ | Comp. Ex |
| 15 | F | 880 | 866 | 590 | 83 | 890 | 687 | 874 | 48 | 28 | 35 | 1.6 | ○ | ○ | ○ | Invention |
| 16 | G | 890 | 867 | 600 | 81 | 830 | 680 | 875 | 53 | 30 | 28 | 1.4 | ○ | ○ | ○ | Invention |
| 17 | G | 870 | 867 | 650 | 77 | 860 | 680 | 875 | 54 | 29 | 27 | 1.1 | ○ | ○ | ○ | Comp. Ex |
| 18 | G | 900 | 867 | 590 | 75 | 655 | 680 | 875 | 59 | 38 | 19 | 1.0 | ○ | ○ | ○ | Comp. Ex |
| 19 | H | 880 | 864 | 600 | 77 | 860 | 721 | 872 | 52 | 29 | 30 | 1.4 | ○ | ○ | ○ | Invention |
| 20 | H | 820 | 864 | 580 | 80 | 830 | 721 | 872 | 53 | 29 | 29 | 1.1 | ○ | ○ | ○ | Comp. Ex |
| 21 | I | 890 | 872 | 520 | 75 | 830 | 672 | 880 | 43 | 28 | 37 | 1.6 | ○ | ○ | ○ | Invention |
| 22 | J | 870 | 868 | 560 | 80 | 820 | 675 | 875 | 44 | 27 | 38 | 1.6 | Δ | X | X | Comp. Ex |
| 23 | K | 880 | 867 | 600 | 81 | 830 | 685 | 873 | 49 | 28 | 35 | 1.5 | X | Δ | X | Comp. Ex |
| 24 | L | 900 | 874 | 500 | 77 | 830 | 670 | 882 | 45 | 27 | 34 | 1.3 | ○ | ○ | ○ | Comp. Ex |
| 25 | M | 880 | 861 | 540 | 82 | 860 | 731 | 870 | 57 | 33 | 21 | 1.0 | ○ | ○ | ○ | Comp. Ex |
| 26 | N | 890 | 865 | 600 | 80 | 890 | 684 | 876 | 51 | 36 | 31 | 1.0 | ○ | ○ | ○ | Comp. Ex |
| 27 | O | 880 | 869 | 590 | 76 | 800 | 672 | 880 | 43 | 28 | 33 | 1.3 | ○ | ○ | ○ | Comp. Ex |
| 28 | P | 890 | 866 | 610 | 80 | 830 | 686 | 878 | 54 | 31 | 27 | 1.3 | Δ | X | X | Comp. Ex |
| 29 | Q | 880 | 868 | 580 | 78 | 810 | 678 | 879 | 42 | 26 | 26 | 1.4 | ○ | ○ | ○ | Comp. Ex |

Examinations were conducted as follows:

Tensile characteristics

A tensile test was conducted by using JIS 5 test piece and tensile strength, yield and elongation were examined in the rolling direction.

The Lankford value ($\bar{r}$ value) was determined from the s obtained in the rolling direction ($r_0$), 45° C. to the rolling direction ($r_{45}$) and 90° C. to the rolling direction ($r_{90}$), in accordance with the following formula:

$$\bar{r}\ \text{value} = (r_0 + 2\ r_{45} + r_{90})/4$$

The r values were determined by measuring the widths of the test piece under 15% strain, at three points: namely, longitudinal mid point and two points which are 12.5 mm apart from the mid point in both directions.

Phosphating treatment characteristics

Phosphating treatment characteristics were evaluated synthetically from the weight of the coating film, P ratio, crystal grain size and distribution of crystal size.

Hot-dip plating characteristics

Hot-dip plating characteristics were evaluated on the basis of resistance to powdering.

Zn-Ni Electroplating characteristics

Zn-Ni electroplating characteristic were evaluated on the basis of plating adhesiveness.

The phosphating treatment characteristics, hot-dip zinc plating characteristic and Zn-Ni electroplating characteristics were evaluated in 3 ranks: namely, ◯ (Excellent), Δ (Good) and x (Not good) as shown in Table 5.

From Table 4, it will be seen that all the steels prepared in accordance with the present invention showed tensile strength values not smaller than 40 kgf/mm$^2$, as well as high ductility and deep drawability, whereas the comparison examples, which do not meet the requirements of the invention either in the chemical composition or process condition, were inferior in tensile characteristics or in surface treatment characteristics. All the steels meeting the requirements of the invention had ferrite single-phase structure.

The steel slab Sample No. 27, which is a comparison example, is different from Sample No. 9 of the invention mainly in the value of the ratio (Si wt. %+10P wt. %)/Mn wt. %. Namely, in Sample No. 27. the value of the above-mentioned ratio is 0.14 which is below the lower limit (0.2) of the range specified by the invention. Sample No. 27, therefore, exhibits inferior of elongation and the Lankford value ($\bar{r}$ value) as compared with Sample No. 9, although the surface treatment characteristics are substantially the same. The steel slab Sample No. 28, which is a comparison example, is different from Sample No. 16 of the invention mainly in the value of the ratio (Si wt. % +10P wt. %)/Mn wt. %. Namely, in Sample No. 28. the value of the above-mentioned ratio is 5.16 which is above the upper limit (3.20) of the range specified by the invention. Sample No. 28, therefore, exhibits inferior surface treatment characteristics as compared with Sample No. 16, although the tensile characteristics are substantially the same.

Sample No. 29, which also is a comparison example, has a composition similar to that of Sample No. 9, except that the C content is increased to attain an equivalent level of tensile strength TS to that of Sample No. 9 which contains Mo. Sample No. 29 exhibits inferos of elongation and Lankford value ($\bar{r}$ value) as compared with Sample No. 9.

Example 2

Nb is added alone or together with Ti

Steels having compositions shown in Table 5 were processed in the same manner as Example 1, into steel sheets of 1.2 mm thick, and characteristics were examined in the same way as Example 1, the results being shown in Table 6.

TABLE 5

| Steel | Composition (wt %) | | | | | | | | | | | | | | (Si + 10P)/ |
|---|---|---|---|---|---|---|---|---|---|---|---|---|---|---|---|
| type | C | Si | Mn | Mo | Ti | Nb | B | Al | P | S | N | Others | Tic* | $Ti_c$* + $Nb_c$ | Mn |
| A | 0.0028 | 0.15 | 2.23 | 0.20 | 0.052 | 0.011 | 0.0010 | 0.046 | 0.050 | 0.003 | 0.0024 | | 0.0098 | 0.0112 | 0.29 |
| B | 0.0049 | 0.10 | 1.81 | 0.20 | 0.061 | 0.013 | 0.0007 | 0.034 | 0.048 | 0.004 | 0.0018 | | 0.0122 | 0.0139 | 0.32 |
| C | 0.0070 | 0.12 | 1.65 | 0.25 | 0.065 | 0.022 | 0.0008 | 0.042 | 0.050 | 0.003 | 0.0020 | | 0.0134 | 0.0162 | 0.38 |
| D | 0.0097 | 0.20 | 1.58 | 0.20 | 0.072 | 0.025 | 0.0009 | 0.059 | 0.049 | 0.003 | 0.0023 | | 0.0149 | 0.0181 | 0.44 |
| E | 0.0042 | 0.51 | 1.42 | 0.10 | 0.047 | 0.009 | 0.0015 | 0.051 | 0.036 | 0.003 | 0.0033 | | 0.0078 | 0.0090 | 0.61 |
| F | 0.0047 | 0.11 | 1.00 | 0.30 | 0.070 | 0.015 | 0.0010 | 0.077 | 0.130 | 0.004 | 0.0038 | | 0.0127 | 0.0147 | 1.41 |
| G | 0.0060 | 0.22 | 1.31 | 0.55 | 0.068 | 0.043 | 0.0006 | 0.048 | 0.071 | 0.006 | 0.0027 | | 0.0124 | 0.0180 | 0.71 |
| H | 0.0035 | 0.10 | 0.80 | 0.23 | 0.057 | 0.013 | 0.0009 | 0.044 | 0.061 | 0.005 | 0.0021 | Cu = 0.5 | 0.0106 | 0.0123 | 0.89 |
| I | 0.0041 | 0.05 | 1.11 | 0.22 | 0.047 | 0.018 | 0.0006 | 0.046 | 0.043 | 0.003 | 0.0031 | Ni = 0.6 | 0.0060 | 0.0103 | 0.43 |
| J | 0.0022 | 0.20 | 0.54 | 0.22 | 0.015 | 0.063 | 0.0010 | 0.051 | 0.048 | 0.004 | 0.0023 | Cu = 1.0<br>Ni = 0.6 | 0.0003 | 0.0084 | 1.26 |
| K | 0.0035 | 0.05 | 1.22 | — | 0.057 | 0.024 | 0.0007 | 0.034 | 0.085 | 0.005 | 0.0034 | | 0.0095 | 0.0095 | 0.74 |
| L | 0.0038 | 0.09 | 1.82 | — | 0.049 | — | 0.0012 | 0.057 | 0.071 | 0.005 | 0.0028 | | 0.0080 | 0.0080 | 0.44 |
| M | 0.0027 | 0.04 | 1.42 | 0.15 | 0.058 | 0.009 | 0.0015 | 0.044 | 0.022 | 0.006 | 0.0024 | | 0.0102 | 0.0114 | 0.18 |
| N | 0.0031 | 0.36 | 0.40 | 0.40 | 0.042 | 0.034 | 0.0016 | 0.043 | 0.140 | 0.005 | 0.0019 | | 0.0070 | 0.0114 | 4.40 |
| O | 0.0620 | 0.13 | 1.27 | 0.30 | 0.230 | 0.081 | 0.0010 | 0.055 | 0.066 | 0.007 | 0.0026 | | 0.0526 | 0.0631 | 0.62 |
| P | 0.0086 | 0.33 | 1.50 | 0.25 | 0.029 | 0.013 | 0.0014 | 0.047 | 0.054 | 0.006 | 0.0024 | | 0.0029 | 0.0046 | 0.58 |
| Q | 0.0031 | 0.43 | 3.50 | 0.20 | 0.054 | 0.020 | 0.0016 | 0.039 | 0.038 | 0.005 | 0.0030 | | 0.0091 | 0.0116 | 0.23 |
| R | 0.0051 | 1.85 | 1.20 | 0.10 | 0.051 | 0.018 | 0.0010 | 0.048 | 0.057 | 0.006 | 0.0028 | | 0.0081 | 0.0104 | 2.02 |
| S | 0.0087 | 0.25 | 1.56 | 0.35 | 0.036 | 0.043 | 0.0012 | 0.044 | 0.180 | 0.005 | 0.0031 | | 0.0045 | 0.0100 | 1.31 |

TABLE 5-continued

| Steel type | Composition (wt %) | | | | | | | | | | | | | | (Si + 10P)/ Mn |
|---|---|---|---|---|---|---|---|---|---|---|---|---|---|---|---|
| | C | Si | Mn | Mo | Ti | Nb | B | Al | P | S | N | Others | Tic* | $Ti_c^* + Nb_c$ | |
| T | 0.0057 | 0.15 | 1.62 | 0.26 | — | 0.105 | 0.0007 | 0.049 | 0.052 | 0.005 | 0.0024 | | — | 0.0096 | 0.41 |
| U | 0.0044 | 0.20 | 1.34 | 0.30 | 0.010 | 0.056 | 0.0012 | 0.044 | 0.061 | 0.007 | 0.0030 | | −0.0027 | 0.0072 | 0.60 |

Note:
1) Ti* = (12/48)Ti-(12/32)S-(12/14)N
2)Ti*c = 12/48Ti*
3)$Ti^*_c + Nb_c$ = Ti* + 12/93 Nb wt %
4) Underlined values fall out of range of invention.
5) A to J and T and U are steels of invention, while others are comparison examples.

TABLE 6

| Sample No. | Sample Symbol | Whether composition meet requirements of invention | Whether process meet requirements of invention | Hot-rolling condition FRT (°C.) | Hot-rolling condition CT (°C.) | Cold rolling reduction (%) | Annealing temp. (°C.) | YS (kgf/mm²) | TS (kgf/mm²) | El (%) | TS × El (kgf/mm² %) | $\bar{r}$ value | TS × El value (kgf/mm²) | Phosphating characteristics | Platability: Electro plating | Platability: Hot-dip plating |
|---|---|---|---|---|---|---|---|---|---|---|---|---|---|---|---|---|
| 1 | A | Yes | Yes | 880 | 600 | 75 | 810 | 29.5 | 49.3 | 37.8 | 1864 | 1.64 | 91 | ○ | ○ | ○ |
| 2 | A | Yes | No | 880 | 450 | 75 | 810 | 31.6 | 51.2 | 32.7 | 1674 | 1.43 | 76 | ○ | ○ | ○ |
| 3 | A | Yes | No | 880 | 720 | 75 | 810 | 29.0 | 45.6 | 37.2 | 1696 | 1.60 | 73 | ○ | ○ | ○ |
| 4 | A | Yes | No | 880 | 600 | 50 | 810 | 29.9 | 49.5 | 36.7 | 1817 | 1.15 | 57 | ○ | ○ | ○ |
| 5 | B | Yes | Yes | 870 | 550 | 75 | 800 | 28.5 | 48.1 | 38.4 | 1847 | 1.94 | 93 | ○ | ○ | ○ |
| 6 | C | Yes | Yes | 890 | 650 | 80 | 830 | 28.1 | 50.0 | 37.7 | 1885 | 1.76 | 88 | ○ | ○ | ○ |
| 7 | C | Yes | No | 890 | 400 | 80 | 830 | 30.2 | 50.5 | 33.3 | 1682 | 1.44 | 73 | ○ | ○ | ○ |
| 8 | D | Yes | Yes | 900 | 550 | 70 | 800 | 30.0 | 51.1 | 35.3 | 1804 | 1.69 | 86 | ○ | ○ | ○ |
| 9 | E | Yes | Yes | 900 | 550 | 65 | 800 | 26.8 | 45.5 | 41.5 | 1888 | 1.98 | 90 | ○ | ○ | ○ |
| 10 | F | Yes | Yes | 900 | 550 | 75 | 850 | 31.8 | 53.0 | 35.0 | 1855 | 1.74 | 92 | ○ | ○ | ○ |
| 11 | G | Yes | Yes | 900 | 600 | 75 | 800 | 31.4 | 55.1 | 33.9 | 1868 | 1.65 | 91 | ○ | ○ | ○ |
| 12 | H | Yes | Yes | 920 | 550 | 75 | 820 | 30.5 | 48.1 | 39.7 | 1910 | 1.88 | 90 | ○ | ○ | ○ |
| 13 | I | Yes | Yes | 870 | 600 | 75 | 820 | 31.2 | 49.3 | 38.8 | 1913 | 1.85 | 91 | ○ | ○ | ○ |
| 14 | J | Yes | Yes | 870 | 650 | 75 | 880* | 43.6 | 55.2 | 34.8 | 1921 | 1.80 | 99 | ○ | ○ | ○ |
| 15 | K | No | Yes | 900 | 550 | 70 | 800 | 27.5 | 46.2 | 30.5 | 1409 | 1.12 | 52 | ○ | ○ | ○ |
| 16 | L | No | Yes | 880 | 550 | 70 | 800 | 28.0 | 47.2 | 30.1 | 1421 | 1.10 | 52 | ○ | ○ | ○ |
| 17 | M | No | Yes | 880 | 550 | 70 | 800 | 23.5 | 39.1 | 48.0 | 1877 | 2.10 | 82 | ○ | ○ | ○ |
| 18 | N | No | Yes | 900 | 550 | 70 | 820 | 35.0 | 53.5 | 25.7 | 1375 | 1.06 | 57 | Δ | X | X |
| 19 | O | No | Yes | 900 | 550 | 75 | 820 | 41.3 | 62.9 | 20.7 | 1302 | 1.01 | 64 | ○ | ○ | ○ |
| 20 | P | No | Yes | 900 | 550 | 70 | 820 | 35.4 | 51.1 | 23.4 | 1196 | 1.05 | 54 | ○ | ○ | ○ |
| 21 | Q | No | Yes | 900 | 550 | 70 | 780 | 32.9 | 55.2 | 28.6 | 1579 | 1.03 | 57 | ○ | ○ | Δ |
| 22 | R | No | Yes | 920 | 600 | 70 | 810 | 33.4 | 53.2 | 30.6 | 1628 | 1.44 | 77 | X | Δ | X |
| 23 | S | No | Yes | 900 | 600 | 70 | 800 | 36.8 | 60.1 | 27.1 | 1629 | 1.20 | 72 | Δ | X | X |
| 24 | T | Yes | Yes | 920 | 600 | 75 | 850 | 32.0 | 49.9 | 36.7 | 1831 | 1.95 | 97 | ○ | ○ | ○ |
| 25 | U | Yes | Yes | 880 | 600 | 75 | 840 | 31.0 | 49.3 | 36.6 | 1804 | 1.87 | 92 | ○ | ○ | ○ |

Note)
1) Underlined values do not fall within ranges specified by the invention.
2) Mark * indicates that steel has undergone 300-sec soaking at recrystallization temperature of 550° C.

Results of examinations of tensile characteristics and surface treatment characteristics are shown in Table 6 together with conditions of the hot-rolling, cold-rolling and annealing. The slab heating temperature was 1150 to 1250° C., and the annealing of a cold rolled strip was conducted by a continuous annealing process (soaking period 5 seconds), followed by temper rolling at a rolling reduction of 0.8%.

Experiments and evaluation were conducted in the same manners as those in Example 1.

From Tables 5 and 6, it will be seen that steels meeting the conditions of the invention exhibit superior surface treatment characteristics and a high tensile strength of 40 kgf/mm$^2$, as well as high ductility and deep drawability in good balance to each other. In contrast, steels of comparison examples having compositions which do not meet the requirements of the invention are inferior either in tensile characteristics or in surface treatment characteristics. Sample Nos. 2, 3, 4 and 7 have compositions meeting the requirements of the invention but are produced under processing conditions which do not meet the requirements of the invention. These samples show slightly inferior material characteristics as compared with Sample Nos. 1 to 6 which meet the requirements of the invention both in composition and process conditions.

All the samples meeting the conditions of the invention had ferrite single-phase structures.

Sample No. 17, which is a comparison example, had the value of the ratio (Si wt. % +10P wt. %)/Mn wt. % of 0.18 which is below the lower limit (0.2) of the range specified by the invention. This sample showed tensile strength below 40 kgf/mm$^2$, although the surface treatment characteristics are substantially equivalent to those of the samples meeting the conditions of the present invention. Sample No. 18, had a value of the above-mentioned ratio of 4.40 which largely exceeds the upper limit (3.3) of the invention of this application and is inferior in surface treatment characteristics.

As will be understood from the foregoing description, according to the present invention, it is possible to obtain a steel sheet suitable for deep drawing, superior both in surface treatment characteristics and the balance between strength and deep drawability, by addition of elements such as Mo, Nb, Ti and B, as well as Si, Mn and P having high solid-solution strengthening effect, in good balance with one another. This steel sheet can suitably be used as the materials of, for example, automotive inner and outer panels which are to be subjected to anti-rust surface treatments.

Furthermore, the present invention offers an advantage in that it eliminates the necessity for any treatment before and after annealing or at the inlet side of a continuous hot-dip plating, which have been heretofore necessary to surface-treat steel sheets which exhibit inferior surface treatment characteristics due to addition of a large amount of Si.

What is claimed is:

1. A high-tension steel sheet having a tensile strength not lower than 40 kgf/mm$^2$, suitable for deep drawing and having superior surface treatment characteristics, said steel sheet being made of a steel consisting essentially of, by weight: 0.001 to 0.05% of C; not more than 1.0% of Si; not more than 2.5% of Mn; 0.05 to 1.0% of Mo; one or both of 0.001 to 0.2% of Nb and not more than 0.3% of Ti, wherein $Ti^*\% + (48/93)Nb\% \geqq (48/12)C\%$ in which $Ti^*\% = Ti\% - (48/32)S\% - (48/14)N\%$, wherein, when $Ti^*\% < 0$, $Ti^*\%$ is regarded as being 0; 0.005 to 0.01% of B; 0.01 to 0.10% of Al; not more than 0.15% of P; not more than 0.010% of S; not more than 0.006% of N; Si, Mn and P meeting the condition of $0.2 < (Si\% + 10P\%)/Mn\% < 3.3$; and the balance substantially Fe and incidental impurities.

2. A high-tension steel sheet having a tensile strength not lower than 40 kgf/mm$^2$, suitable for deep drawing and having superior surface treatment characteristics, said steel sheet being made of a steel consisting essentially of, by weight: 0.001 to 0.05% of C; not more than 1.0% of Si; not more than 2.5% of Mn; 0.05 to 1.0% of Mo; one or both of 0.001 to 0.2% of Nb and not more than 0.3% of Ti, wherein $Ti^*\% + (48/93)Nb\% \geqq (48/12)C\%$ in which $Ti^*\% = Ti\% - (48/32)S\% - (48/14)N\%$, wherein, when $Ti^*\% < 0$, $Ti^*\%$ is regarded as being 0; 0.0005 to 0.01% of B; 0.01 to 0.10% of Al; not more than 0.15% of P; not more than 0.010% of S; not more than 0.006% of N; 0.05 to 2.0% of Ni alone or in combination with 0.05 to 2.0% of Cu; Si, Mn and P meeting the condition of $0.2 < (Si\% + 10P\%)/Mn\% < 3.3$; and the balance substantially Fe and incidental impurities.

3. A method of producing a high-tension steel sheet having a tensile strength not lower than 40 kgf/mm$^2$, suitable for deep drawing and having superior surface treatment characteristics, comprising the steps of:

preparing a steel slab made of a steel consisting essentially of, by weight: 0.001 to 0.05% of C; not more than 1.0% of Si; not more than 2.5% of Mn; 0.05 to 1.0% of Mo; one or both of 0.001 to 0.2% of Nb and not more than 0.3% of Ti, wherein $Ti^*\% + (48/93Nb\% \geqq (48/12)C\%$ in which $Ti^*\% = Ti\% - (48/32)S\% - (48/14)N\%$, wherein, when $Ti^*\% < 0$, $Ti^*\%$ is regarded as being 0; 0.0005 to 0.01% of B; 0.01 to 0.10% of Al; not more than 0.15% of P; not more than 0.010% of S; not more than 0.006% of N; Si, Mn and P meeting the condition of $0.2 < (Si\% + 10P\%)Mn\% < 3.3$; and the balance substantially Fe and incidental impurities;

hot-rolling said steel slab to obtain hot rolled steel strip a final hot-rolling temperature not lower than the $Ar_3$ transformation temperature; coiling said steel strip at a temperature not lower than 300° C. but not higher than 615° C. when Nb is not contained and not lower than 500° C. but not higher than 700° C. when Nb is contained; cold-rolling said steel strip to obtain a cold rolled strip at a rolling reduction not smaller than 65%; and recrystallization-annealing said cold rolled strip at a temperature not lower than the recrystallization temperature but below the $Ac_3$ transformation temperature.

4. A method of producing a high-tension steel sheet having a tensile strength not lower than 40 kgf/mm$^2$, suitable for deep drawing and having superior surface treatment characteristics, said method comprising the steps of:

preparing a steel slab made of steel consisting essentially of, by weight; 0.001 to 0.005% of C; not more than 1.0% of Si; not more than 2.5% of Mn; 0.05 to 1.0% of Mo; one or both of 0.001 to 0.2% of Nb and not more than 0.3% of Ti, wherein $Ti + \% + (48/93)Nb\% \geqq (48/12)C\%$ in which $Ti^*\% = Ti\% - (48/32)S\% - (48/14)N\%$, wherein, when $Ti^*\% < 0$, $Ti^*\%$ is regarded as being 0; 0.0005 to 0.01% of B; 0.01 to 0.10% of Al; not more than 0.15% of Pl not more than 0.010% of S; not more than 0.006% of N; 0.05 to 2.0% of Ni alone or in combination with 0.05 to 2.0% of Cu; Si, Mn and P meeting the condition of $0.2<(Si\%+10P\%)/Mn\%<3.3$; and the balance substantially Fe and incidental impurities;

hot-rolling said steel slab to obtain a hot rolled steel strip at a final hot-rolling temperature not lower than the $Ar^3$ transformation temperature; coiling said steel strip at a temperature not lower than 300° C. but not higher than 615° C. when Nb is not contained and not lower than 500° C. but not higher than 700° C. when Nb is contained; cold-rolling said steel strip to obtain a cold rolled strip at a rolling reduction not smaller than 65%; and recrystallization-annealing said cold rolled steel strip at a temperature not lower than the recrystallization temperature but below the $Ac_3$ transformation temperature.

* * * * *